US007967940B2

(12) United States Patent
Moon et al.

(10) Patent No.: US 7,967,940 B2
(45) Date of Patent: Jun. 28, 2011

(54) METHOD FOR MANUFACTURING WATER BOTTLE MOUNTING SUPPLIER

(75) Inventors: Young Mu Moon, Gunpo-si (KR); Hyung Min Park, Anyang-si (KR)

(73) Assignee: Clover Co., Ltd. (KR)

( * ) Notice: Subject to any disclaimer, the term of this patent is extended or adjusted under 35 U.S.C. 154(b) by 207 days.

(21) Appl. No.: 12/227,247

(22) PCT Filed: May 17, 2007

(86) PCT No.: PCT/KR2007/002415

§ 371 (c)(1),
(2), (4) Date: Jan. 15, 2009

(87) PCT Pub. No.: WO2007/133053

PCT Pub. Date: Nov. 22, 2007

(65) Prior Publication Data

US 2009/0229746 A1 Sep. 17, 2009

(30) Foreign Application Priority Data

May 17, 2006 (KR) ..... 10-2006-0044391

(51) Int. Cl.
*B32B 37/00* (2006.01)
*B29C 65/00* (2006.01)

(52) U.S. Cl. ..... 156/293; 156/308.2; 222/185.1; 141/18; 141/364

(58) Field of Classification Search ..... 156/293, 156/294, 308.2; 114/18, 351, 352, 353, 363, 114/364; 222/185.1; 141/18, 351, 352, 353, 363, 364

See application file for complete search history.

(56) References Cited

U.S. PATENT DOCUMENTS

| | | | | |
|---|---|---|---|---|
| 4,846,236 | A | 7/1989 | Deruntz | |
| 5,280,764 | A | 1/1994 | Levinrad et al. | |
| 5,957,316 | A * | 9/1999 | Hidding et al. | 215/265 |
| 5,997,797 | A * | 12/1999 | Heuchert | 264/500 |
| 6,029,860 | A | 2/2000 | Donselman et al. | |
| 6,123,232 | A | 9/2000 | Donselman et al. | |
| 6,648,180 | B2 * | 11/2003 | Moon et al. | 222/185.1 |
| 2002/0129869 | A1 * | 9/2002 | Hydak et al. | 141/352 |

FOREIGN PATENT DOCUMENTS

| | | | |
|---|---|---|---|
| KR | 20-1999-0002170 | U | 9/2000 |
| KR | 2003-81098 | Y1 | 3/2005 |

* cited by examiner

*Primary Examiner* — John L Goff

(74) *Attorney, Agent, or Firm* — Harness, Dickey & Pierce, P.L.C.

(57) ABSTRACT

Provided is a method for manufacturing a water bottle mounting supplier. The method includes the steps of: a) integrally forming a water bottle mounting unit, a water supply pipe, and a supporting rod using a top and bottom mold, where the water bottle mounting unit is formed in a funnel shape for supporting the water bottle, the water supply pipe is projected from a bottom center of the water bottle mounting unit toward a top, and an inlet formed at a side of the top for supplying water downwardly, and the supporting rod projected from an upper center of the water supply pipe toward a top; and b) connecting a stopper fixing unit to the supporting rod, where the stopper fixing unit is formed in a semicircle shape and includes a through-hole formed at a center in a vertical direction to receive the supporting rod.

2 Claims, 3 Drawing Sheets

[Fig. 1]
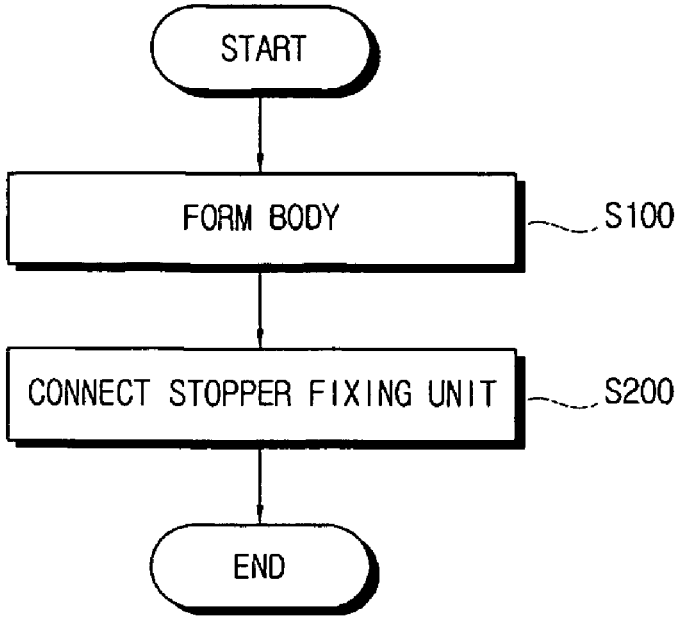
[Fig. 2]
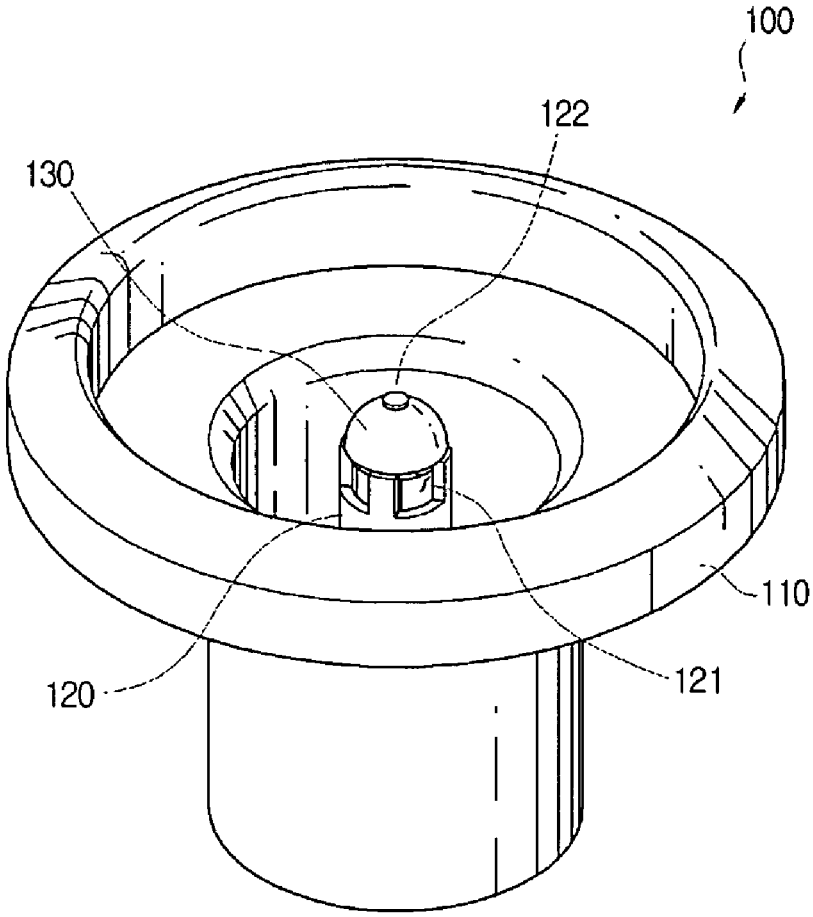

[Fig. 3]
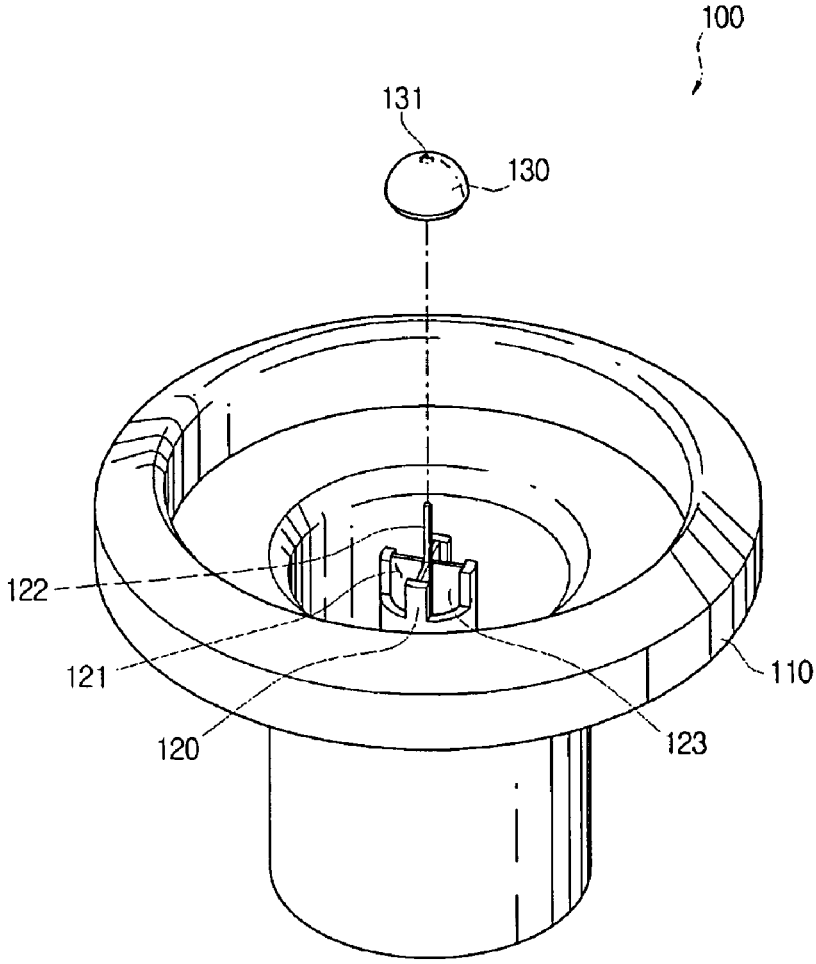
[Fig. 4]
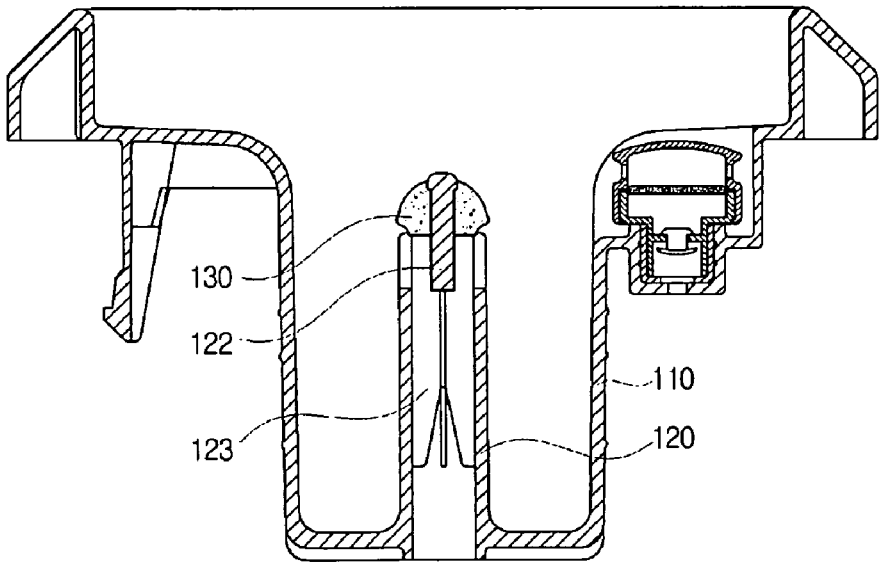

[Fig. 5]
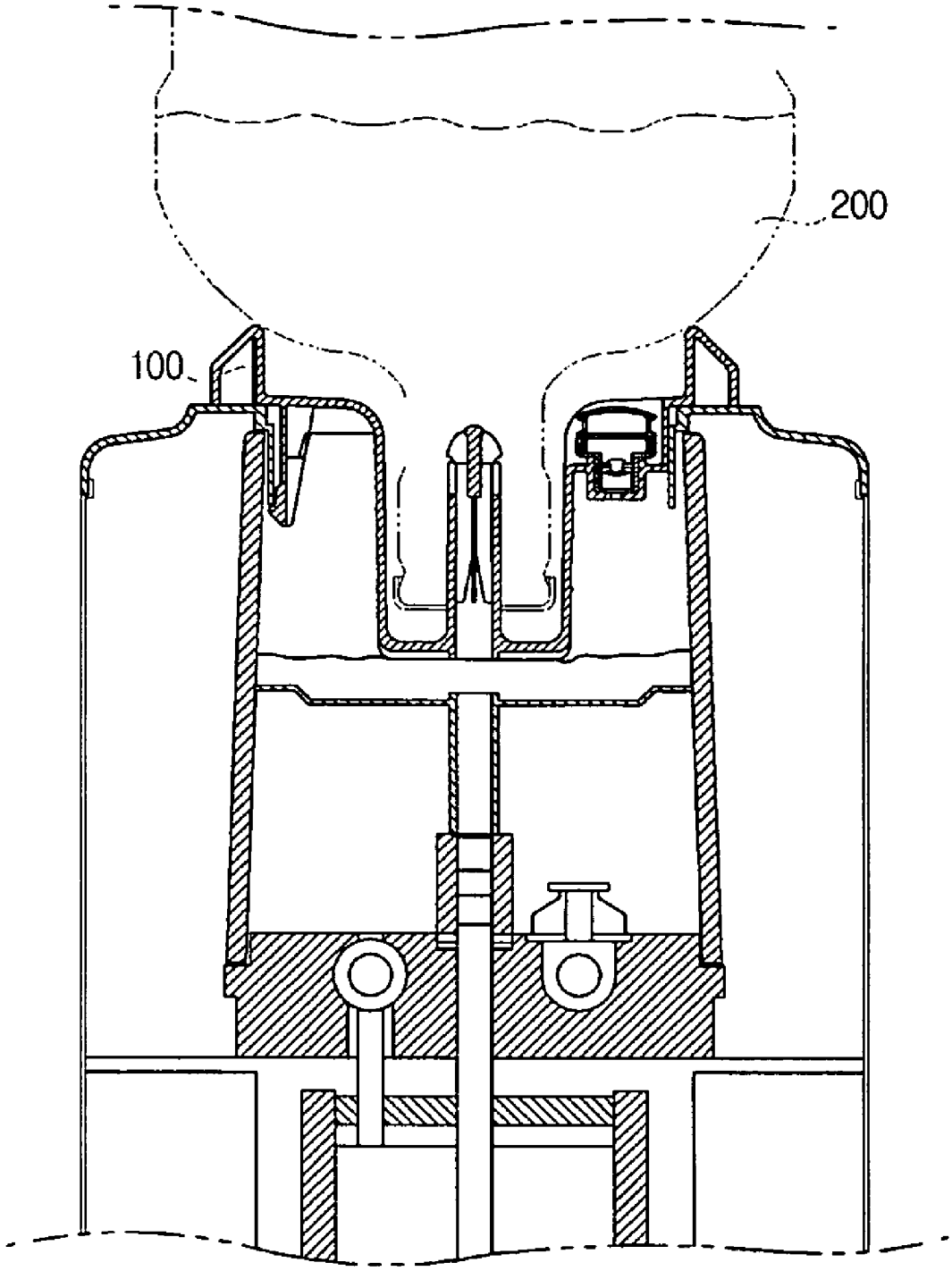

METHOD FOR MANUFACTURING WATER BOTTLE MOUNTING SUPPLIER

CROSS-REFERENCE TO RELATED APPLICATIONS

This application is a National Stage of International Application No. PCT/KR2007/002415, filed May 17, 2007 and published in English as WO 2007/133053 A1 on Nov. 22, 2007. This application claims the benefit of KR 10-2006-0044391 filed May 17, 2006. The disclosures of the above applications are incorporated herein by reference.

TECHNICAL FIELD

The present invention relates to a method for manufacturing a water bottle mounting supplier, and more particularly, to a method for manufacturing a water bottle mounting supplier for supplying water by mounting a water bottle having a dual stopper on a water dispenser.

BACKGROUND ART

In general, a water bottle is mounted on the top of a water dispenser with the water bottle upside down. In order to hold the water bottle, a water bottle mounting supplier is disposed on the top of the water dispenser. The water bottle mounting supplier includes a water supply pipe that is inserted into the entry of the water bottle for supplying water in the water bottle to the water dispenser.

Since a user needs to turn a water bottle upside down in order to mount the water bottle on the water dispenser, a user may spill water when the user mounts the water bottle on the water dispenser. In order to overcome such a shortcoming of the water dispenser, a water bottle with a dual stopper was introduced.

The dual stopper includes an outer stopper for concealing the neck of the water bottle and an inner stopper for concealing a pipe formed at the center of the dual stopper. When the water bottle with the dual stopper is mounted on the top of the water dispenser with the water bottle upside down, the water supply pipe pushes the inner stopper into the water bottle and is inserted into a pipe formed at the center of the stopper. Therefore, the water supply pipe is inserted into the water bottle without the water spilled.

Since the top end of the water supply pipe becomes stopped by the inner stopper while the inner stopper is inserted into the water bottle, a water-inlet is formed at the side of the water supply pipe to penetrate the water supply pipe.

In order to form the water-inlet at the side of the water supply pipe to penetrate the side, the water bottle mounting supplier is manufactured separately from a water supply pipe using a mold with a slide core that operates in a horizontal direction. After separately manufacturing the water bottle mounting supplier and the water supply pipe, they are assembled together.

As described above, the water bottle mounting supplier is manufactured through complicated and annoying processes as described above, using a mold with a slide core operating in a cross direction by manufacturing a water supply pipe, forming a water-inlet to penetrate the side of the water supply pipe, and assembling the water supply pipe with the water bottle mounting unit.

After forming the water bottle mounting supplier using the mold with the slide core operating in the horizontal direction, the water supply pipe is manufactured, the inlet is formed at the side of the water supply pipe, and the water supply pipe is assembled to the water bottle mounting supplier. Such complicated and annoying processes make the manufacture cost thereof increased.

The slide core of the mold, which operates in the horizontal direction, forms a mark on the side surface of the water supply pipe in the horizontal direction. Since the outer stopper of the water bottle operates in a longitudinal direction that is vertical to the mark formed in the horizontal direction, the outer stopper of the water bottle may be damaged or broken when the water bottle is mounted on the water dispenser. The parts separated from the outer stopper may enter into the water that is supplied to a user through a water supply pipe.

Moreover, it takes a long time to assemble the water bottle mounting supplier with the water supply pipe, which are manufactured separately, parts may be defected while the water bottle mounting supplier is assembled with the water supply pipe, and water may be leaked because the water bottle mounting supplier is not tightly assembled with the water supply pipe.

DISCLOSURE OF INVENTION

Technical Problem

It is, therefore, an object of the present invention to provide a method for integrally manufacturing a water bottle mounting supplier without using a mold having no slide core.

Other objects and advantages of the present invention will be described below and identified by preferred embodiments of the present invention. Moreover, the objects and advantages of the present invention can be embodied by means and combinations set forth in the appended claims.

Technical Solution

In accordance with one aspect of the present invention, there is a method for manufacturing a water bottle mounting supplier that enables a water bottle with a dual stopper having an inner stopper and an outer stopper to be mounted on a water dispenser with the water bottle upside down, including the steps of: a) integrally forming a water bottle mounting unit, a water supply pipe, and a supporting rod using a top and bottom mold, where the water bottle mounting unit is formed in a funnel shape having a wide top and a narrow bottom and includes a circumference member at a top part thereof for supporting the water bottle, the water supply pipe is projected from a bottom center of the water bottle mounting unit toward a top and having a top end inserted into an entry of the water bottle, and an inlet formed at a side of the top for supplying water downwardly, and the supporting rod projected from an upper center of the water supply pipe toward a top and having a diameter smaller than an inner diameter of the water supply pipe; and b) connecting a stopper fixing unit to the supporting rod, where the stopper fixing unit is formed in a semicircle shape to enable the inner stopper of the water bottle to be inserted therein and includes a through-hole formed at a center in a vertical direction to receive the supporting rod.

In the step a), guiding plates may be integrally formed, where each the guiding plates is disposed in a top part of the water supply pipe, and projected from an inner wall of the water supply pipe to the center in a shape of a plate, and top parts of the guiding plates are connected to each others and the guiding plates are inclined to an inner wall of the water supply pipe in a bottom direction.

In the step b), the stopper fixing unit may be assembled to the supporting rod through thermal bonding.

Hereinafter, preferred embodiments of the present invention will now be described with reference to the accompanying drawings.

The terms and words used in this specification and claims are not to be interpreted in common or literal meanings. Based on the principle that an inventor can adequately define the meaning of terms and words to best describe his/her own invention, they shall be interpreted in the meaning and context conforming to the spirit of the present invention.

Accordingly, the embodiment presented in this description and the accompanying drawing is only an example of the most preferred embodiment of the present invention. It will be appreciated by those skilled in the art that changes and modifications can be made without departing from the principles and spirit of the present invention, the scope of which is defined in the appended claims and their equivalents.

Advantageous Effects

In the method for manufacturing a water bottle mounting supplier according to the present invention, the water bottle mounting supplier is integrally manufactured without a mold using a slide core that operates in a horizontal direction. Therefore, the manufacturing processes become simpler and the manufacturing cost can be reduced.

Since the slide core operating in the horizontal direction is not used, it can prevent an outer stopper operating in a vertical direction from being damaged.

Furthermore, the water bottle mounting supplier is integrally manufactured according to the present invention. Therefore, the water bottle mounting supplier is very firm and it is very difficult that the water bottle mounting supplier become deteriorated due to a bad assembling process. Since the water bottle mounting supplier is formed integrally, the water bottle mounting supplier cannot leak the water. Moreover, a guiding plate. formed in the water supply pipe enables the water and the air to smoothly flow. Therefore, the water bottle mounting supplier can supply water to user without interruption.

BRIEF DESCRIPTION OF THE DRAWINGS

The above and other objects and features of the present invention will become apparent from the following description of the preferred embodiments given in conjunction with the accompanying drawings, in which:

FIG. 1 is a flowchart illustrating a method for manufacturing a water bottle mounting supplier according to an embodiment of the present invention;

FIG. 2 is a perspective view of a water bottle mounting supplier manufactured by the method shown in FIG. 1;

FIG. 3 is an exploded perspective view of a water bottle mounting supplier shown in FIG. 2;

FIG. 4 is a cross-sectional view of a water bottle mounting supplier shown in FIG. 2; and FIG. 5 is a cross-sectional view of a water bottle mounting supplier with a water bottle mounted at the top of a water dispenser.

BEST MODE FOR CARRYING OUT THE INVENTION

FIG. 1 is a flowchart illustrating a method for manufacturing a water bottle mounting supplier according to an embodiment of the present invention, FIG. 2 is a perspective view of a water bottle mounting supplier manufactured by the method shown in FIG. 1, FIG. 3 is an exploded perspective view of a water bottle mounting supplier shown in FIG. 2, FIG. 4 is a cross-sectional view of a water bottle mounting supplier shown in FIG. 2, and FIG. 5 is a cross-sectional view of a water bottle mounting supplier with a water bottle mounted at the top of a water dispenser.

Referring to FIGS. 1 to 5, the method of manufacturing a water bottle mounting supplier according to the present embodiment includes a body forming step, and a stopper fixing unit assembly step.

At first, the body forming step S100 will be described.

At the body forming step S100, the body of the water bottle mounting supplier 100 is integrally formed using a top and bottom mold with no slide core.

The body includes a water bottle mounting unit 110 and a water supply pipe 120.

The water bottle mounting unit 110 is formed in a shape of a funnel having a wide top and a narrow bottom. The water bottle mounting unit 110 has a circumference member at a top part thereof for supporting the water bottle 200.

The water supply pipe 120 is projected from the bottom center of the water bottle mounting unit 10 to the top. Therefore, the water supply pipe 120 is inserted into the entry of the water bottle 200 when the water bottle 200 is mounted on the water bottle mounting unit 110.

When the water supply pipe 120 is inserted into the entry of the water bottle 200, the upper part of the water supply pipe 120 is stopped by an inner stopper (not shown) of the water bottle 120 and the water enters through an inlet 121 formed at the side of the upper part of the water supply pipe 120.

When the water enters through the inlet 121 and flows toward the bottom of the water supply pipe 120, air is supplied to the water bottle 200 through the water supply pipe 120 at the same time. Since the water flows to the opposite direction of the air, the water cannot smoothly flow toward the bottom.

Therefore, it is preferable to form at least one of guiding plates 123 in the water supply pipe 120 to make the water to smoothly flow.

The guiding plates 123 are disposed at the inner top part of the water supply pipe 120, and are projected from the inner wall of the water supply pipe 120 to the center in a shape of a plate. The guide plates 123 are connected at the top side and inclined to the inner wall of the water supply pipe 120 in a bottom direction.

If four of the guiding plates 123 are disposed, the water supply pipe 120 is divided into four parts by the guiding plates 123, and the flows of water and the air are also divided into four parts. Therefore, the water and the air smoothly flow without the water and air collided.

Since the guiding plates 123 are inclined into the inner side wall in the bottom direction, the guiding plates 123 guide water to the inner side wall of the water supply pipe 120.

Therefore, the water flows along the inner side wall toward the bottom, and the air flow through a space formed at the center of the water supply pipe 120. As a result, the water and the air smoothly flow without disturbing each other at the bottom part of the water supply pipe 120.

Then, the stopper fixing unit assembly step S200 will be described.

At the stopper fixing unit assembly step S200, a stopper fixing unit 130 is connected to a supporting rod 122.

The supporting rod 122 is projected from the upper center of the water supply pipe 120 toward the top and has a diameter smaller than an inner diameter of the water supply pipe 120.

It is preferable to integrally form the supporting rod 122 with the water bottle mounting unit 120 and the water supply pipe 120 at the body forming step S100.

The stopper fixing unit 130 is formed in a semicircle shape to enable an inner stopper (not shown) of the water bottle 200 to be inserted and has a through-hole 131 formed at the center in the vertical direction. Therefore, the supporting rod 122 is connected by being inserted therein.

The supporting rod 122 has an enough length to penetrate the stopper fixing unit 130 and be projected toward the top of the stopper fixing unit 130. The projected part of the supporting rod 122 is fixed to the stopper fixing unit 130 by thermally bonding.

Herein, it is preferable that the inner diameter of the through-hole 131 formed at the stopper fixing unit 130 may increase in the top direction like the through hole 131. Therefore, if the projected part of the supporting rod 122 is thermally bonded, it is hardened to have a diameter increasing in the top direction like the through-hole 131.

The shapes of the through-hole 131 and the supporting rod 122 make the stopper fixing unit 130 to be firmly assembled to the supporting rod 122.

As described above, although the present invention has been described and illustrated with reference to preferred embodiments and drawings, it should be understood that various modifications and variations of the present invention can be made thereto by those skilled in the art without departing from the spirit and the technical scope of the present invention as defined by the appended claims.

The invention claimed is:

1. A method for manufacturing a water bottle mounting supplier that enables a water bottle with a dual stopper having an inner stopper and an outer stopper to be mounted on a water dispenser with the water bottle upside down, comprising the steps of:

a) integrally forming a water bottle mounting unit, a water supply pipe, and a supporting rod using a top and bottom mold, where the water bottle mounting unit is formed in a funnel shape having a wide top and a narrow bottom and includes a circumference member at a top part thereof for supporting the water bottle, the water supply pipe is projected from a bottom center of the water bottle mounting unit toward a top of the unit and having a top end inserted into an entry of the water bottle, and an inlet formed at a side of the top end for supplying water downwardly, and the supporting rod projected from an upper center of the water supply pipe toward a top of the pipe and having a diameter smaller than an inner diameter of the water supply pipe; and b) connecting a stopper fixing unit to the supporting rod through thermal bonding, where the stopper fixing unit is formed in a semicircle shape and includes a through-hole formed at a center in a vertical direction to receive the supporting rod.

2. The method of claim 1, wherein in the step a), guiding plates are integrally formed, where each of the guiding plates is disposed in a top part of the water supply pipe, and projected from an inner wall of the water supply pipe to the center in a shape of a plate, and top parts of the guiding plates are connected to each others and the guiding plates are inclined to an inner wall of the water supply pipe in a bottom direction.

* * * * *